US007837521B2

(12) United States Patent
Kato et al.

(10) Patent No.: US 7,837,521 B2
(45) Date of Patent: Nov. 23, 2010

(54) TERMINAL REDUCING A LARGE INSERTION FORCE

(75) Inventors: Hajime Kato, Shizuoka (JP); Nobuaki Yoshioka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/588,456

(22) Filed: Oct. 15, 2009

(65) Prior Publication Data

US 2010/0151748 A1 Jun. 17, 2010

(30) Foreign Application Priority Data

Dec. 15, 2008 (JP) ..... 2008-317795

(51) Int. Cl.
*H01R 13/187* (2006.01)

(52) U.S. Cl. ..... 439/843; 439/851

(58) Field of Classification Search ..... 439/834, 439/843, 844, 845, 846, 849, 850, 851, 852, 439/816, 817, 827, 828
See application file for complete search history.

(56) References Cited

U.S. PATENT DOCUMENTS 2,962,693 A * 11/1960 Ott ..... 439/849
4,456,325 A * 6/1984 Benz ..... 439/816
5,078,618 A * 1/1992 Peloza ..... 439/439
5,261,840 A * 11/1993 Benz ..... 439/843
6,485,337 B2 * 11/2002 Hsieh ..... 439/845
7,445,529 B2 * 11/2008 Takizawa et al. ..... 439/845
2007/0218736 A1 9/2007 Takizawa et al.
2009/0029605 A1 * 1/2009 Matsumoto et al. ..... 439/843

FOREIGN PATENT DOCUMENTS

JP 2007-250362 A 9/2007

* cited by examiner

*Primary Examiner*—Hae Moon Hyeon
(74) *Attorney, Agent, or Firm*—Edwards Angell Palmer & Dodge LLP

(57) ABSTRACT

A terminal including a tube-shaped electrical contact portion into which an insert portion of a mating terminal is inserted. The electrical contact portion includes: a pair of walls arranged in parallel to each other, which the insert portion is inserted between; and a plurality of elastic pieces provided at one wall of the pair of walls so as to be formed projecting from the one wall to the other wall of the pair of walls, and pushing the insert portion toward the other wall so as to hold the insert portion between the plurality of elastic pieces and the other wall. The plurality of elastic pieces is arranged in parallel to each other at an interval along an insertion direction of the insert portion.

2 Claims, 5 Drawing Sheets

TERMINAL REDUCING A LARGE INSERTION FORCE

CROSS-REFERENCES TO RELATED APPLICATIONS

The Japan Patent Application No. 2008-317795 upon which this patent application is based is hereby incorporated by reference.

BACKGROUND OF THE INVENTION

1. Field of the Invention

The present invention relates to a terminal for connecting an electric wire to a connecting terminal of an electrical component such as a bus bar, a relay or a fuse.

2. Description of Related Art

A terminal 101, as shown in Japanese Patent Publication No. 2007-250362, has been used, for example, for a connection between an electric wire and a connecting terminal of an electrical component such as a bus bar, a relay or a fuse. The terminal 101 shown in FIG. 6 includes an electrical contact portion 103 and an electrical connecting portion 105. A plate-like insert portion 110*a* of a mating terminal 110 is inserted into the electrical contact portion 103, so that the electric wire is electrically connected to the connecting terminal of the electrical component such as the bus bar, the relay or the fuse.

The terminal 101 made of electrically conductive flat-plate-shaped sheet metal is formed into L-shape, and is provided with the electrical contact portion 103 at one end thereof and the electrical connecting portion 105 at the other end thereof.

The electrical connecting portion 105 is provided with a hole 105*a* which is to be connected with the electrical component such as the bus bar, the relay or the fuse.

The electrical contact portion 103 is formed into a tube shape with a bottom wall 103*a*, an upper wall 103*c* opposing to the bottom wall 103*a*, and a pair of side walls 103*b* continuing to both the bottom wall 103*a* and the upper wall 103*c*. The electrical contact portion 103 has a spring member 104 including three elastic pieces 104*a* and connecting pieces 104*b*. The three elastic pieces 104*a* and the connecting pieces 104*b* are formed integrally by punching out a flat-plate-shaped metal sheet. The spring member 104 is provided at the bottom wall 103*a* of the electrical contact portion 103.

Each of the three elastic pieces 104*a* is flexible and has a rectangular shape. The three elastic pieces 104*a* are arranged in parallel to each other, at an interval, along a direction perpendicular to z-direction, so that longitudinal direction thereof is parallel to the z-direction. One end of each elastic piece 104*a* in a widthwise direction thereof is arranged to be contacted with the bottom wall 103*a*. The each elastic piece 104*a* is formed to slant the other end thereof in the widthwise direction thereof toward the upper wall 103*c*.

The connecting pieces 104*b* are formed into a plate-like shape and are provided in pairs. The pair of connecting pieces 104*b* is provided on both ends of the bottom wall 103*a* in a longitudinal direction thereof with a space between each other, so that the longitudinal direction thereof is perpendicular to the z-direction. Three elastic pieces 104*a* are positioned between the connecting pieces 104*b*, so that both ends in a longitudinal direction thereof are continuous with the connecting pieces 104*b*. Longitudinal length of each connecting piece 104*b* is substantially same as the width of an inner surface of the bottom wall 103*a*.

For the conventional terminal 101 described above, the insert portion 110*a* of the mating terminal 110 is inserted in between the bottom wall 103*a* and the upper wall 103*c*, and in between the side walls 103*b*. The inserted insert portion 110*a* is then sandwiched and held by the elastic pieces 104*a* and the upper wall 103*c*. The elastic pieces 104*a* push the insert portion 110*a* towards the upper wall 103*c*.

In the manner described above, the terminal 101 connects the electric wire to the connecting terminal of the electrical component such as the bus bar, the relay or the fuse.

However, according to the conventional terminal 101, when the insert portion 110*a* of the mating terminal 110 enters into the electrical contact portion 103, the three elastic pieces 104*a*, arranged in parallel to each other in direction substantially perpendicular to the z-direction, are pushed against the bottom wall 103*a*, and deformed elastically. An elastic restoring force by the deformed three elastic pieces 104*a* is simultaneously generated, pushing the insert portion 110*a* against the upper wall 103*c*. Thus a large force (insertion force) is required in order to insert the insert portion 110*a* into the electrical contact portion 103.

Thus, for example when inspecting the terminal 101, the required large force to insert the insert portion 110*a* into the electrical contact portion 103 causes a heavy workload for a worker. Furthermore, there was a need for applying grease to reduce the insertion force to lighten the workload, increasing a number of working process.

Furthermore, since the longitudinal direction of the elastic pieces 104*a* is arranged in parallel to the z-direction, when the insert portion 110*a* enters into the electrical contact portion 103, the ends on one side of the elastic pieces 104*a* in the longitudinal direction thereof, and a top end of the insert portion 110*a* will contact intersectionally. Thus, the insert portion 110*a* pushes the ends of the elastic pieces 104*a*, causing the spring member 104 to be detached easily from the electrical contact portion 103.

Furthermore, the pair of the connecting pieces 104*b* is provided at ends of the bottom wall 103*a*, so that the longitudinal direction thereof is arranged perpendicular to the z-direction. Thus, when the insert portion 110*a* enters into the electrical contact portion 103, the top end of the insert portion 110*a* pushes the connecting piece 104*b*1 causing the spring member 104 to be detached easily from the electrical contact portion 103.

In view of the above-described problems, an object of the present invention is to provide a terminal which can reduce a large insertion force generated when inserting an insert portion of a mating terminal into an electrical contact portion of the terminal, and which can also reduce a failure rate by preventing a spring member to be detached easily when inserting/pulling out the insert portion of the mating terminal into/from the electrical contact portion of the terminal.

SUMMARY OF THE INVENTION

For achieving the above-described object, a terminal according to claim 1 includes a tube-shaped electrical contact portion into which an insert portion of a mating terminal is inserted. The electrical contact portion includes: a pair of walls arranged in parallel to each other, which the insert portion is inserted between; and a plurality of elastic pieces provided at one wall of the pair of walls so as to be formed projecting from the one wall to the other wall of the pair of walls, and pushing the insert portion toward the other wall so as to hold the insert portion between the plurality of elastic pieces and the other wall. The plurality of elastic pieces is arranged in parallel to each other at an interval along a direction of inserting the insert portion. When the insert portion is inserted into the electrical contact portion, each of the elastic pieces contacts with the insert portion and pushes the insert portion against the other wall, so the insert portion is sandwiched between the plurality of elastic pieces and the other wall.

For achieving the object, a terminal according to claim 2 is the terminal as described above, where each of the elastic pieces is formed in a flat plate shape, and where each of the elastic pieces is formed to incline to the direction of inserting the insert portion, so as to arrange one end of each of the elastic pieces adjacent to an inner surface of the one wall, and the other end thereof lean to the direction of inserting the insert portion.

As explained above, the terminal according to the present invention described in claim 1 is provided with the plurality of elastic pieces arranged in parallel to each other at an interval along the insertion direction of the insert portion. As the insert portion of the mating terminal enters into the electrical contact portion, the insert portion passes over the elastic pieces one by one, so an elastic restoring force increases little by little, dispersively. Thus, the elastic restoring force generated from the elastic pieces arranged along the insertion direction becomes smaller compared to an elastic restoring force generated instantaneously from the plurality of elastic pieces arranged along a direction perpendicular to the insertion direction. Consequently, the terminal which can reduce the insertion force can be provided.

Furthermore, by providing the terminal with a reduced insertion force, a workload for a worker can be lightened when inspecting the terminal, so a process for applying grease can be cut off. Thus, the manufacturing cost of the terminal can be reduced.

As explained above, the terminal according to the present invention described in claim 2 is provided with the elastic pieces arranged so a longitudinal direction thereof is perpendicular to the insertion direction of the insert portion. Each of the elastic pieces is inclined relative to the bottom wall to the insertion direction of the insert portion, where one end of the each elastic piece is arranged adjacent to an inner surface of the bottom wall (arranged to be contacted with the bottom wall). Consequently, when the insert portion is inserted into the electrical contact portion, a top end of the insert portion will not interfere with the elastic pieces. Thus, a risk for detaching a spring member which includes the elastic pieces is lowered, so a failure rate of the terminal can be reduced.

Furthermore, the terminal according to the present invention is provided with a pair of connecting pieces arranged at both ends of the bottom wall, with a longitudinal direction thereof arranged parallel to the insertion direction of the insert portion. On the other hand, the conventional terminal described above is provided with the pair of connecting pieces arranged at both ends of the bottom wall, with the longitudinal direction thereof being arranged perpendicular to the insertion direction of the insert portion. Thus, for the inventive terminal, contacting area of the top end of the insert portion with each end of the connecting pieces is smaller compared to the conventional terminal. Consequently, the interference between the top end of the insert portion and the connecting pieces becomes small. Thus, a risk for detaching the spring member which includes the connecting pieces is lowered, so the failure rate of the terminal can be reduced.

DETAILED DESCRIPTION OF THE PREFERRED EMBODIMENTS

Figure 2:
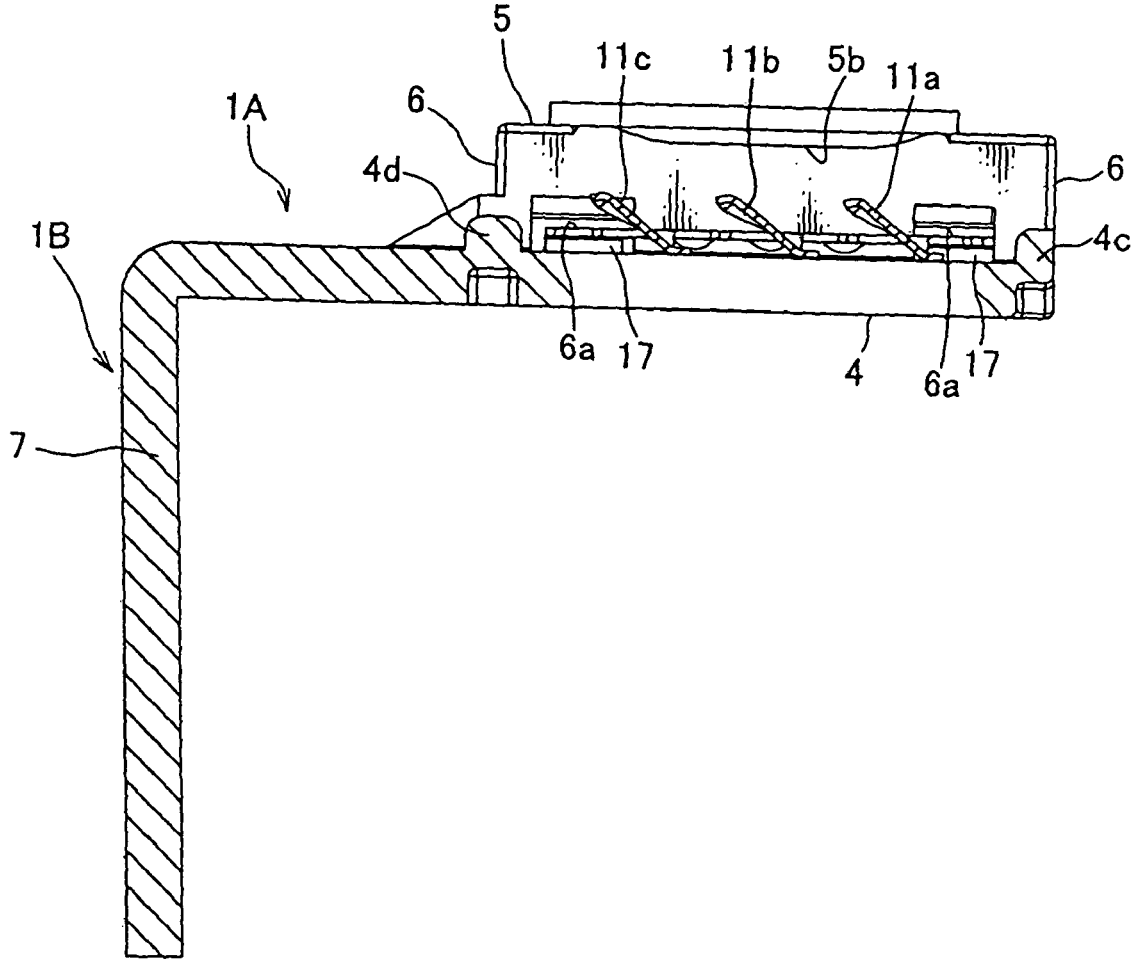
FIG. 2 is a cross-sectional view along A-A shown in FIG. 1.
Figure 3:
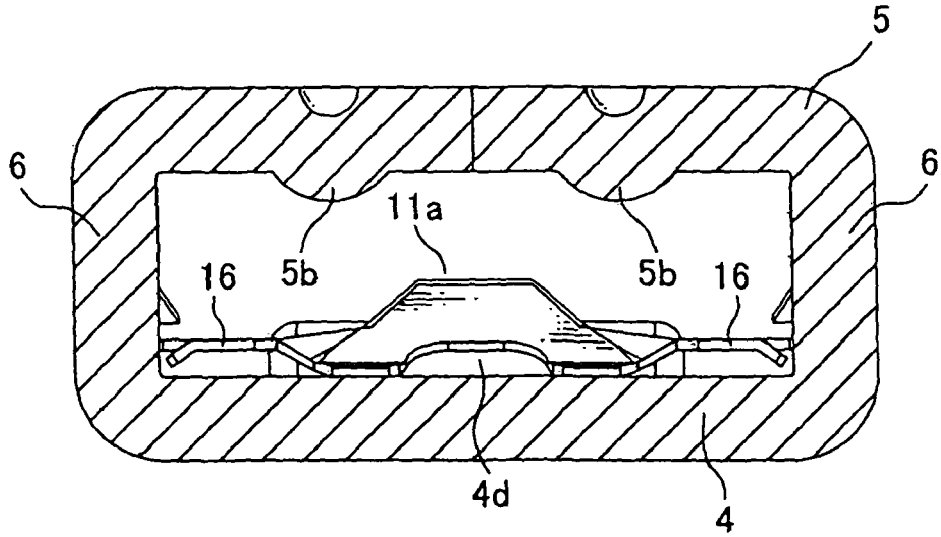
FIG. 3 is a cross-sectional view along B-B shown in FIG. 1.

One embodiment of a terminal according to the present invention will be explained hereinafter in reference to FIGS. 1 to 3. A terminal 1 according to one embodiment of the present invention is used to electrically connect a mating terminal 2 to an electric device via a conductor such as an electric wire, by inserting the mating terminal 2 into the terminal 1.

The mating terminal 2 is made of conductive plate-shaped sheet metal, and is provided with an insert portion 8 at one end thereof and a connection portion 9 at the other end thereof.

Figure 1:
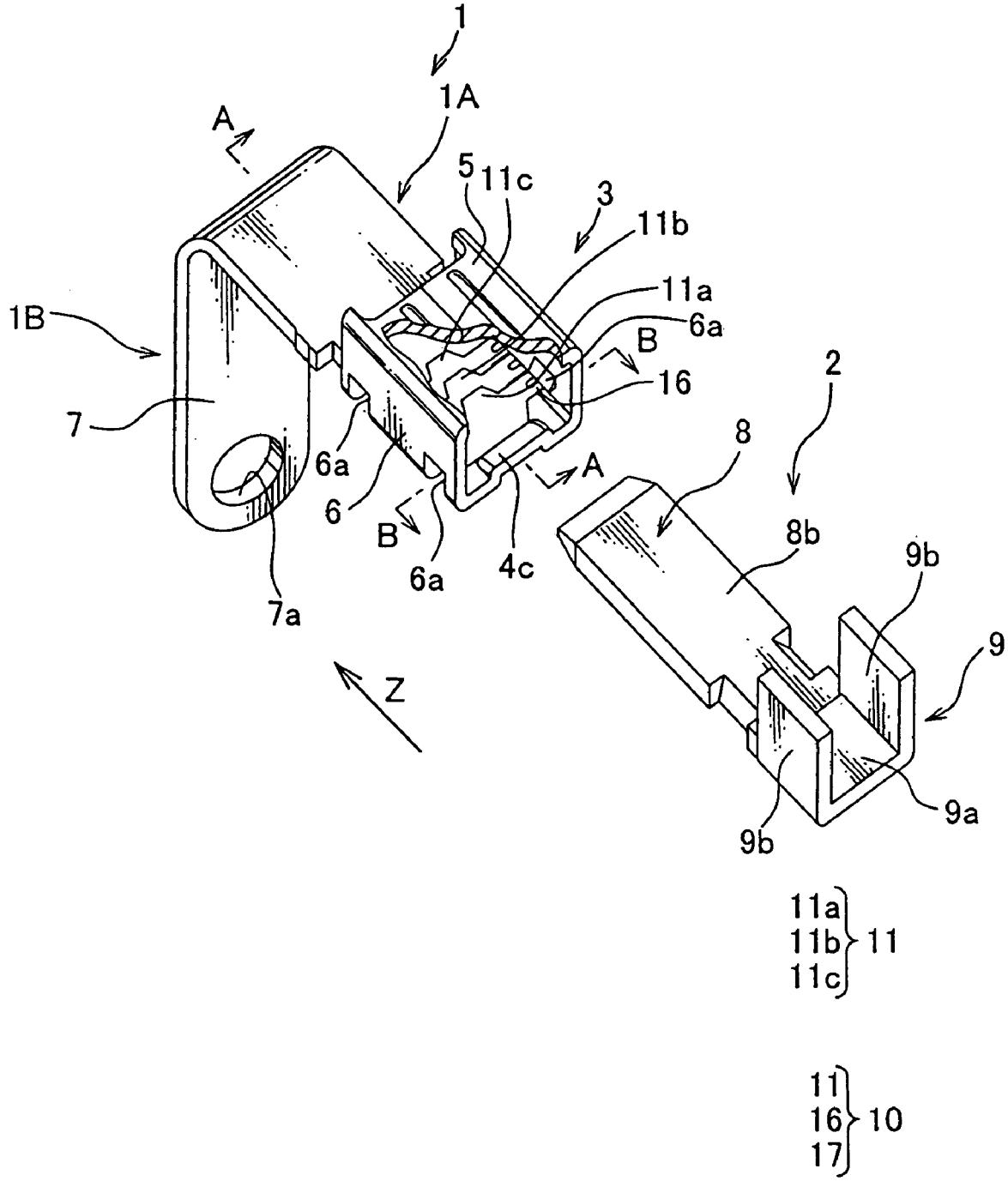
FIG. 1 is a perspective view showing one embodiment of a terminal according to one embodiment of the present invention.

The insert portion 8 is formed in a plate shape and is formed to be thinner towards the tip thereof, so as to be able to enter into an electrical contact portion 3 of the terminal 1, as shown in FIG. 1. The insert portion 8 has one surface (not shown) and the other surface 8*b*, which abut on a bottom wall 4 and an upper wall 5 respectively when inserted into the electrical contact portion 3.

The connection portion 9 of the mating terminal 2 is formed integrally with the insert portion 8, and is provided with a flat-rectangular bottom wall 9*a* continuing to the insert portion 8, and a pair of side walls 9*b* extending upwardly from both longitudinal ends of the bottom wall 9*a*. An electric wire (not shown) is connected to the connection portion 9 by placing a core-exposed portion of the electric wire on the bottom wall 9*a* and bending the side walls 9*b* toward the bottom wall 9*a*, so as to push the electric wire against the bottom wall 9*a*. In this manner, the electric wire is fixed and electrically connected to the connection portion 9.

The terminal 1 made of conductive plate-shaped sheet metal is formed into L-shape with a first plate 1A and a second plate 1B, as shown in FIG. 1. The above-described electrical contact portion 3 is provided to one side of the first plate 1A distant from the second plate 1B. An electrical connecting portion 7 is provided to one side of the second plate 1B distant from the first plate 1A.

The electrical connecting portion 7 is provided with a circular hole 7*a* to which an electrical component, such as a bus bar, a relay or a fuse, is connected.

The electrical contact portion 3 is formed into a rectangular tube shape with: the bottom wall 4 being continuous with the first plate 1A; the upper wall 5 facing the bottom wall 4; and a pair of side walls 6 being continuous with both the bottom wall 4 and the upper wall 5. A width of the bottom wall 4 is designed substantially equal to a width of the first plate 1A. Also, the electrical contact portion 3 includes a spring member 10.

The bottom wall 4 includes a first projection 4*c* and a second projection 4*d*. The first projection 4*c* is provided to an end of the bottom wall 4 distant from the second plate 1B, and the second projection 4*d* is provided to the other end of the bottom wall 4 close to the second plate 1B. The first and the second projections 4*c* and 4*d* are arranged along a direction perpendicular to a z-direction indicated with an arrow, as shown in FIG. 1, so as to be parallel to each other. The first projection 4*c* and the second projection 4*d* have substantially equal height. When the insert portion 8 is inserted into the electrical contact portion 3, both the first and the second projections 4*c* and 4*d* contact with the one surface (not shown) of the insert portion 8.

The upper wall 5 formed in a rectangular shape includes a pair of third projections 5*b* projecting from the upper wall 5 toward the bottom wall 4. A width of the upper wall 5 is designed substantially equal to the width of bottom wall 4. The third projections 5*b* are arranged along the z-direction so as to be parallel to each other at an interval. When the insert portion 8 is inserted into the electrical contact portion 3, the third projections 5*b* contact with the other surface 8*b* of the insert portion 8.

A pair of walls described in the specification corresponds to a pair of the bottom wall 4 and the upper wall 5, and one wall and the other wall described in the specification correspond to the bottom wall 4 and the upper wall 5, respectively.

The rectangular side walls 6 are provided in a pair and are arranged so that each side wall 6 is parallel to each other at an interval. The side walls 6 are continuous with the both longitudinal ends of the bottom wall 4 as well as with the longitudinal ends of the upper wall 5.

Each of the side walls 6 includes rectangular engagement holes 6*a* at an end closer to the bottom wall 4. Each side wall 6 has two engagement holes 6*a*, thus the pair of the side walls 6 has total of four engagement holes 6*a*. The spring member 10 can be fixed inside the electrical contact portion 3 by hereinafter-described engagement pieces 17 of the spring member 10 being engaged to the engagement holes 6*a*.

The insert portion 8 is inserted into the above-described electrical contact portion 3. More specifically, the insert portion 8 is inserted into the electrical contact portion 3 along the z-direction which is parallel to a longitudinal direction of the first plate 1A. The z-direction corresponds to an insertion direction of the insert portion 8. The electrical contact portion 3 places the inserted insert portion 8 between the bottom wall 4 and the upper wall 5, as well as between each of the side walls 6.

The spring member 10 made of conductive plate-shaped sheet metal is provided integrally with three elastic pieces 11, a pair of connecting pieces 16 and the four engagement pieces 17.

A plurality of elastic pieces 11 are provided to the spring member 10. In one embodiment, the three elastic pieces 11 are arranged in parallel to each other at an interval along the z-direction, so that a longitudinal direction thereof is perpendicular to the z-direction. The three elastic pieces 11 include a first elastic piece 11*a*, a second elastic piece 11*b* and a third elastic piece 11*c*. The first elastic piece 11*a* is placed farthest away from the second plate 1B, and the third elastic piece 11*c* is placed closest to the second plate 1B.

Each of the elastic pieces 11 has a flat-plate shape and is flexible. The elastic pieces 11 are provided at the bottom wall 4 and are formed to incline relative to the bottom wall 4 toward the z-direction, as shown in FIG. 2. One end of the each elastic piece 11 is arranged adjacent to an inner surface of the bottom wall 4 (arranged to be contacted with the bottom wall 4), and the other end thereof leans to the z-direction. When the insert portion 8 is inserted into the electrical contact portion 3, the other ends of the elastic pieces 11 contact with the one surface (not shown) of the insert portion 8. The insert portion 8 pushes the elastic pieces 11 towards the bottom wall 4. The pushed elastic pieces 11 then pushes back, by an elastic restoring force, the insert portion 8 against the upper wall 5. Consequently, the insert portion 8 is sandwiched between the elastic pieces 11 and the upper wall 5.

The band-plate-shaped connecting pieces 16 are provided in a pair. The each of the connecting pieces 16 is provided at both longitudinal ends of the bottom wall 4, respectively, as shown in FIG. 1, so that the connecting pieces 16 are arranged in parallel to each other at an interval. A longitudinal direction of the connecting pieces 16 is parallel to the z-direction. One end of the each of the three elastic pieces 11 in a longitudinal direction thereof is in contact with one end of the each connecting piece 16 in a longitudinal direction thereof. A longitudinal length of the connecting pieces 16 is shorter than a longitudinal length of the inner surface of the bottom wall 4. As shown in FIG. 2 and FIG. 3, the connecting pieces 16 are arranged to face to the bottom wall 4 so that there is a space between the connecting pieces 16 and the bottom wall 4. A distance from the bottom wall 4 to the connecting piece 16 is shorter than the height of the first projection 4*c*.

The pair of the connecting pieces 16 has four engagement pieces 17, the each connecting piece 16 having two engagement pieces 17. The engagement pieces 17 are projected from an end of the connecting piece 16 which is opposite of an end contacting with the elastic pieces 11. The engagement pieces 17 can penetrate through the engagement holes 6*a* of the side walls 6, so as to fix the spring member 10 to inside of the electrical contact portion 3.

The procedure of fitting the mating terminal 2 to the terminal 1 is explained hereinafter.

Firstly, a top end of the insert portion 8 is inserted into the electrical contact portion 3 from a side distant from the second plate 1B, so the one surface (not shown) of the insert portion 8 abuts on the bottom wall 4 and the other surface 8*b* abuts on the upper wall 5. As the insert portion 8 further enters into the electrical contact portion 3 along the z-direction, the insert portion 8 will contact first with the first projection 4*c*, then with both the third projections 5*b* and the first elastic piece 11*a*. When the insert portion 8 contacts with the first elastic piece 11*a*, the insert portion 8 pushes the first elastic piece 11*a* against the bottom wall 4, deforming the first elastic piece 11*a*. The deformation of the first elastic piece 11*a* generates the elastic restoring force which pushes back the insert portion 8 against the upper wall 5. Consequently, the insert portion 8 is sandwiched between the first elastic piece 11*a* and the upper wall 5.

As the insert portion 8 further continues to enter into the electrical contact portion 3, the insert portion 8 will contact with the second elastic piece 11*b*. Then, the insert portion 8 pushes the first and the second elastic pieces 11*a* and 11*b* against the bottom wall 4, deforming the two elastic pieces 11*a* and 11*b*. Then, due to the elastic restoring force generated by the two elastic pieces 11*a* and 11*b*, the insert portion 8 is pushed back against the upper wall 5, so the insert portion 8 is sandwiched between the two elastic pieces 11*a* and 11*b*, and the upper wall 5. In the same manner, as the insert portion 8 further continues to enter into the electrical contact portion 3, the insert portion 8 contacts with the third elastic piece 11*c*. Thus, the insert portion 8 pushes the first, the second and the third elastic pieces 11*a*, 11*b* and 11*c* against the bottom wall 4, deforming the three elastic pieces 11*a*, 11*b* and 11*c*. Then, due to the elastic restoring force generated by the three elastic pieces 11*a*, 11*b* and 11*c*, the insert portion 8 is pushed back against the upper wall 5, so the insert portion 8 is sandwiched between the three elastic pieces 11*a*, 11*b* and 11*c*, and the upper wall 5. Consequently, the mating terminal 2 is fitted into the terminal 1, electrically connecting the terminal 1 and the mating terminal 2.

According to the above-described terminal 1, the plurality of elastic pieces 11 of the terminal 1 are arranged in parallel to each other at an interval along the insertion direction of the insert portion. As the insert portion 8 of the mating terminal 2 enters into the electrical contact portion 3, the insert portion 8 passes over the elastic pieces 11 one by one, so an elastic restoring force increases little by little, dispersively. Thus, the elastic restoring force generated from the plurality of elastic pieces 11 arranged along the insertion direction becomes smaller compared to an elastic restoring force generated instantaneously from the plurality of elastic pieces 104*a* arranged along a direction perpendicular to the insertion direction. Consequently, the terminal which can reduce the insertion force can be provided.

Furthermore, by providing the terminal with a reduced insertion force, a workload for a worker can be lightened when inspecting the terminal, so a process for applying grease can be cut off. Thus, the manufacturing cost of the terminal can be reduced.

Furthermore, the terminal 1 according to the present invention is provided with the elastic pieces 11 arranged so a longitudinal direction thereof is perpendicular to the insertion direction of the insert portion 8. Each of the elastic pieces 11 is inclined relative to the bottom wall 4 to the insertion direction of the insert portion 8, with the one end of the each elastic piece 11 arranged adjacent to an inner surface of the bottom wall 4. Consequently, when the insert portion 8 is inserted into the electrical contact portion 3, the top end of the insert portion 8 does not interfere with the elastic pieces 11. Thus, a risk for detaching the spring member 10 which includes the elastic pieces 11 is lowered, so a failure rate of the terminal 1 can be reduced.

The terminal 1 according to the present invention is provided with the pair of connecting pieces 16 arranged at both ends of the bottom wall 4, with a longitudinal direction thereof arranged parallel to the insertion direction of the insert portion 8. On the other hand, the conventional terminal 101 described above is provided with the pair of connecting pieces 104*b* arranged at both ends of the bottom wall 103*a*, with a longitudinal direction thereof being arranged perpendicular to the insertion direction of the insert portion 110*a*. Thus, for the inventive terminal 1, contacting area of the top end of the insert portion 8 with each end of the connecting pieces 16 is smaller compared to the conventional terminal 101. Consequently, the interference between the top end of the insert portion 8 and the connecting pieces 16 becomes small. Thus, a risk for detaching the spring member 10 which includes the connecting pieces 16 is lowered, so the failure rate of the terminal 1 can be reduced.

Figure 4:
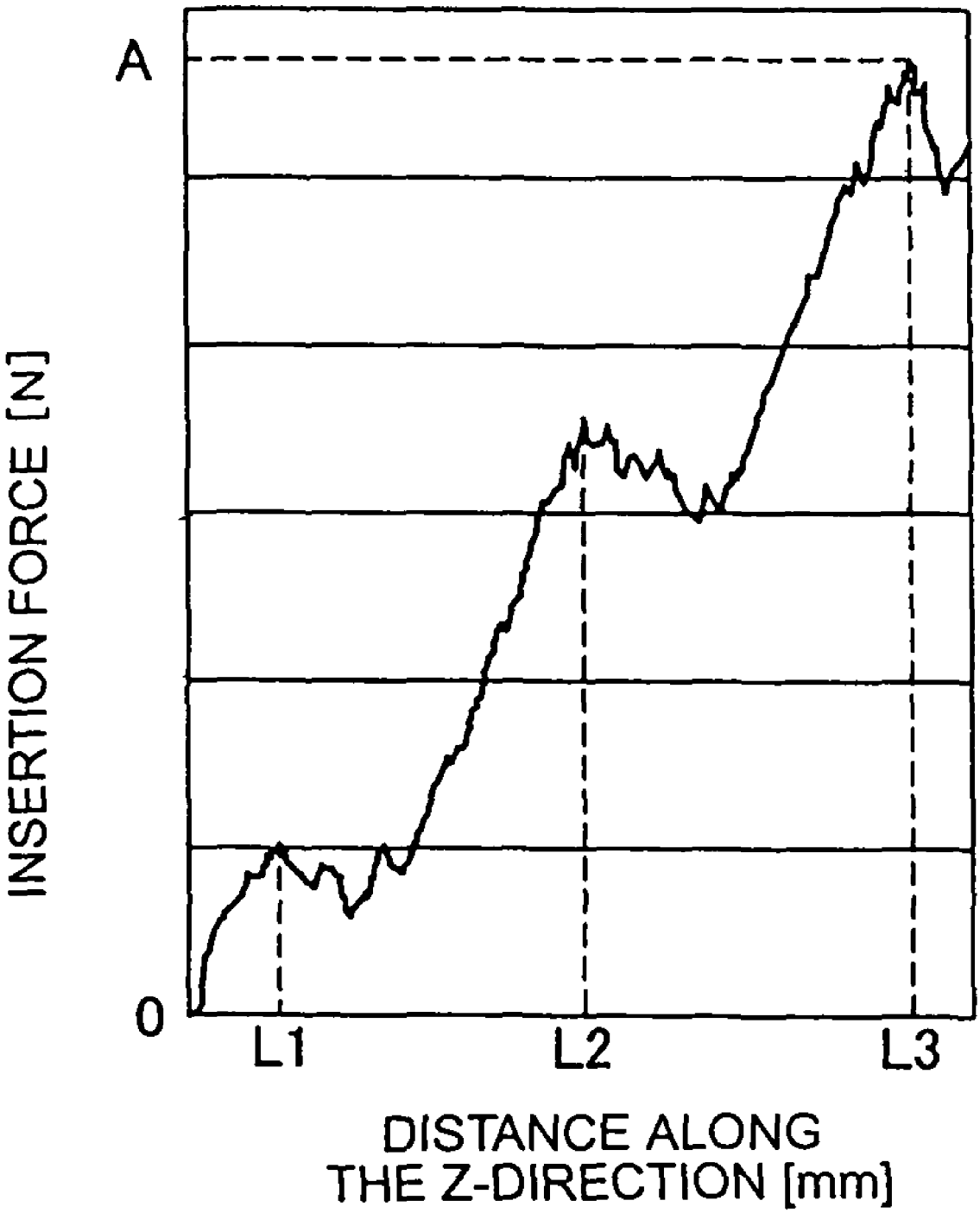
FIG. 4 is a graph showing a measurement result of a change in an insertion force for the terminal according to the present invention.

The force (insertion force) required when inserting the insert portion 8 of the mating terminal 2 into the electrical contact portion 3 of the terminal 1, is measured to examine the effect of the present invention. The result is shown in FIG. 4. For a comparative example, the same was measured for the conventional terminal 101, where the insert portion 110*a* is inserted into the electrical contact portion 103. The result is shown in FIG. 5.

A horizontal axis of the graph shown in FIG. 4 indicates the distance along the z-direction, the distance from an end of the bottom wall 4 distant from the second plate 1B to the top end of the insert portion 8. A vertical axis of the graph indicates the insertion force generated when the insert portion 8 is inserted into the electrical contact portion 3.

Figure 5:
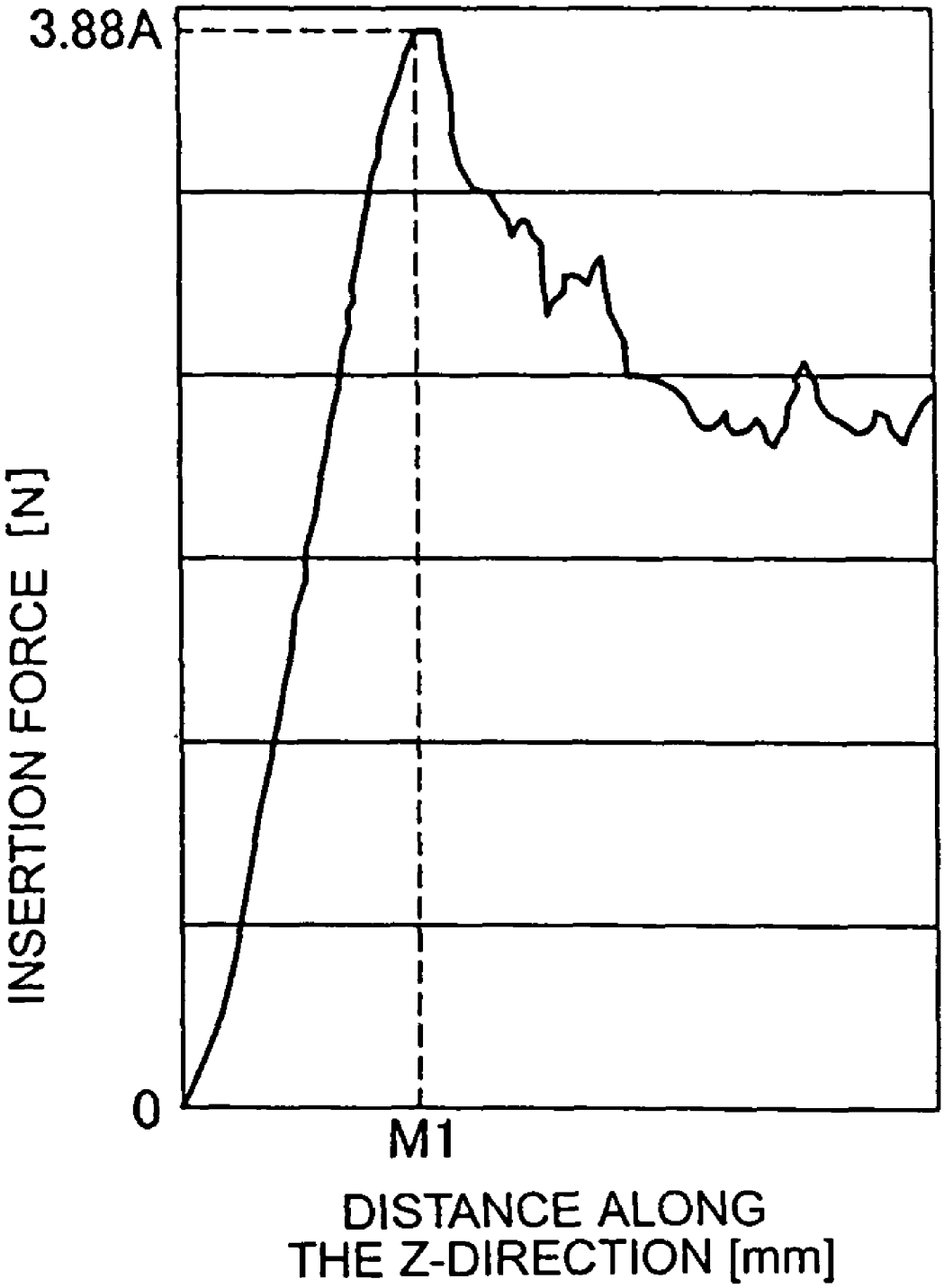
FIG. 5 is a graph showing a measurement result of a change in an insertion force for a conventional terminal shown in FIG. 6.
Figure 6:
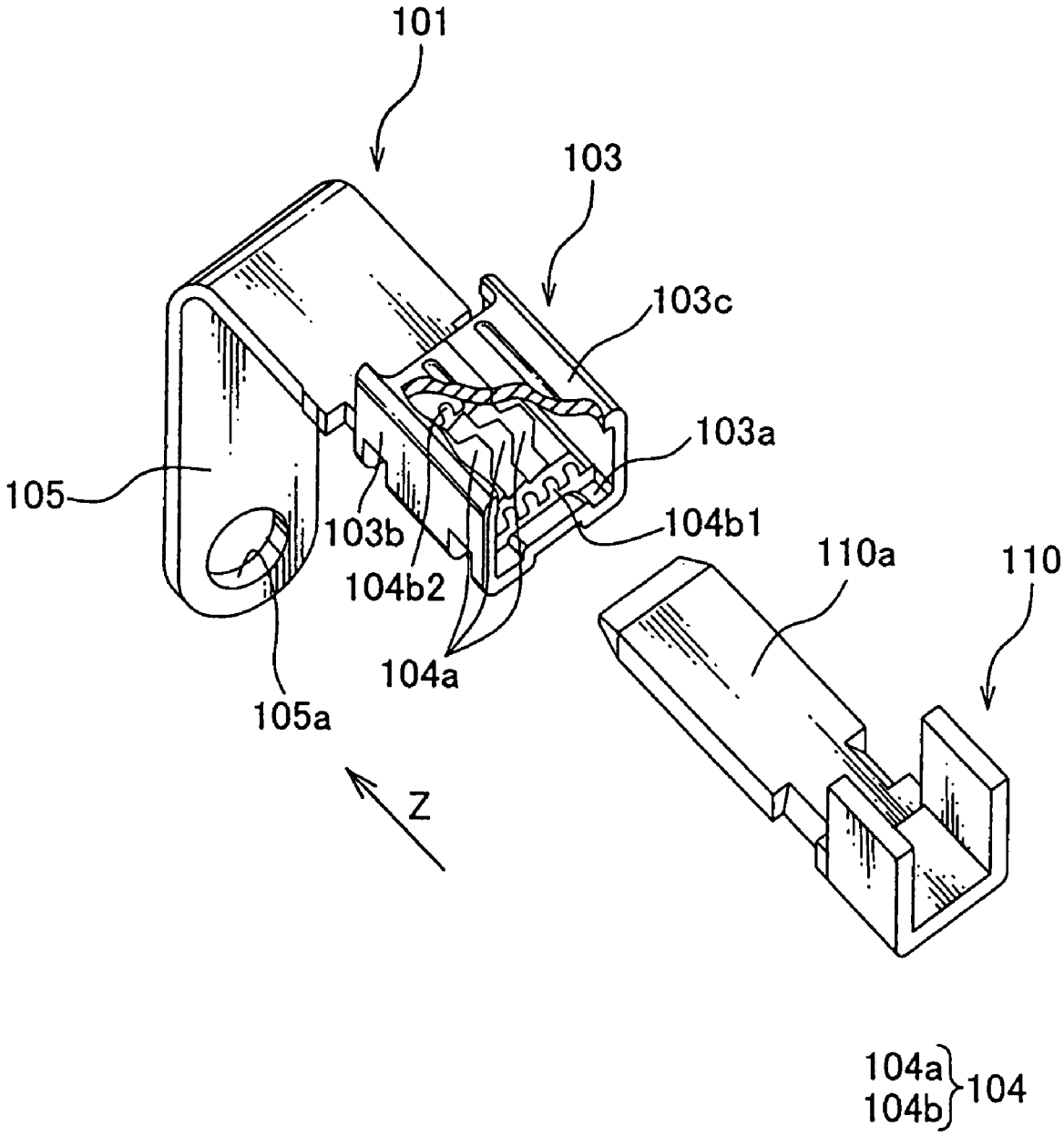
FIG. 6 PRIOR ART
FIG. 6 is a perspective view showing one embodiment of the conventional terminal.

The horizontal axis of the graph shown in FIG. 5 indicates the distance along the z-direction, the distance from the one end of the bottom wall 103*a* distant from the electrical connecting portion 105 to a top end of the insert portion 110*a*. The vertical axis of the graph indicates the insertion force when the insert portion 110*a* is inserted into the electrical contact portion 103.

Inner surfaces of the bottom wall 103*a* of the conventional terminal 110*a* and the bottom wall 4 of the inventive terminal 1 are formed to have the equal width. The height from the connecting piece 16 of the side wall 6 to the upper wall 5 and the height from the connecting piece 104 of the side wall 103*b* to the upper wall 103*c* are formed equal. Also, the thicknesses of the inventive spring member 10 and the conventional spring member 104 are formed equal. Also, the widths and the thicknesses of the inventive insert portion 8 and the conventional insert portion 110*a* are formed equal.

L1, L2, and L3 shown in FIG. 4, represent states of the inventive insert portion 8 passing over the first, the second, and the third elastic pieces 11*a*, 11*b*, 11*c*, respectively. As it is clearly observed from the FIG. 4, for the inventive terminal 1, the insertion force generated as the insert portion 8 entering into the electrical contact portion 3 increases little by little as the insert portion 8 passes over the each of the three elastic pieces 11 one by one. The maximum insertion force observed at L3 was A [N].

M1, shown in FIG. 5, represents a state of the conventional insert portion 110*a* passing over the three elastic pieces 104*a* all at once. As it is clearly observed from the FIG. 5, for the comparative example using the conventional terminal, the insertion force generated as the insert portion 110*a* entering into the electrical contact portion 103 reaches to its maximum value, 3.88 A [N], at M1.

The results observed in FIGS. 4 and 5 show that the terminal 1 according to the present invention can reduce the maximum insertion force compared to the comparative example.

The elastic pieces 11 may be formed integrally with the bottom wall 4. In the specification, the expression "the one end of the each of the elastic pieces 11 is formed adjacent to the inner surface of the one wall (the bottom wail 4)" includes the one end of the each of the elastic pieces 11 being formed integrally with the bottom wall 4 or formed separately from the bottom wall 4.

The embodiments described herein only indicate the representative embodiments, and the present invention is not limited to those embodiments. Various modifications and variations can be made within the scope of the invention described herein.

What is claimed is:

1. A terminal having a tube-shaped electrical contact portion into which an insert portion of a mating terminal is inserted, the electrical contact portion comprising:

a pair of walls arranged in parallel to each other, which the insert portion is inserted between; and a plurality of elastic pieces provided at one wall of the pair of walls so as to be formed projecting from the one wall to the other wall of the pair of walls, and pushing the insert portion toward the other wall so as to hold the insert portion between the plurality of elastic pieces and the other wall, wherein the plurality of elastic pieces is arranged in parallel to each other at an interval along a direction of inserting the insert portion.

2. The terminal as claimed in claim 1, wherein each of the elastic pieces is formed in a flat plate shape, and wherein each of the elastic pieces is formed to incline to the direction of inserting the insert portion, so as to arrange one end of each of the elastic pieces adjacent to an inner surface of the one wall, and the other end thereof lean to the direction of inserting the insert portion.

* * * * *